US007758037B2

(12) United States Patent
Pillard

(10) Patent No.: US 7,758,037 B2
(45) Date of Patent: Jul. 20, 2010

(54) DEVICE FOR AUTOMATICALLY LOADING ENVELOPES

(75) Inventor: Romain Pillard, Avon (FR)

(73) Assignee: NEOPOST Technologies, Bagneux (FR)

( * ) Notice: Subject to any disclaimer, the term of this patent is extended or adjusted under 35 U.S.C. 154(b) by 109 days.

(21) Appl. No.: 11/984,365

(22) Filed: Nov. 16, 2007

(65) Prior Publication Data

US 2008/0122159 A1 May 29, 2008

(30) Foreign Application Priority Data

Nov. 16, 2006 (FR) ..... 06 54934

(51) Int. Cl.
*B65H 5/06* (2006.01)

(52) U.S. Cl. ..... 271/3.17; 271/3.03; 271/3.05

(58) Field of Classification Search ..... 271/3.03, 271/3.02, 3.04, 2, 3.17, 35, 221, 3.05
See application file for complete search history.

(56) References Cited

U.S. PATENT DOCUMENTS 3,612,511 A * 10/1971 Godlewski ..... 271/35
3,776,544 A * 12/1973 Watson et al. ..... 271/3.03
3,870,294 A * 3/1975 Donner ..... 271/3.03
5,996,988 A * 12/1999 Helmstadter et al. ..... 271/110
6,105,952 A * 8/2000 Helmstadter et al. ..... 271/3.02
7,297,930 B2 * 11/2007 Defosse ..... 250/222.1

FOREIGN PATENT DOCUMENTS

EP 0 581 392 A2 2/1994
FR 2 169 605 A 9/1973
JP 58-140889 A 8/1983

* cited by examiner

*Primary Examiner*—Kaitlin S Joerger
(74) *Attorney, Agent, or Firm*—Sughrue Mion, PLLC

(57) ABSTRACT

An envelope loader device comprising a mail-receiving bed provided with conveyor rollers and serving to receive a stack of mail items, jogger means for holding the mail items against a referencing wall, a drive motor for driving said conveyor rollers in rotation, and control means for actuating said drive motor and for causing a fraction of said stack of mail items to be ejected as a function of a mail presence sensor mounted at said mail-receiving bed and whose state depends on whether or not mail items are present in a downstream feeder device.

7 Claims, 2 Drawing Sheets

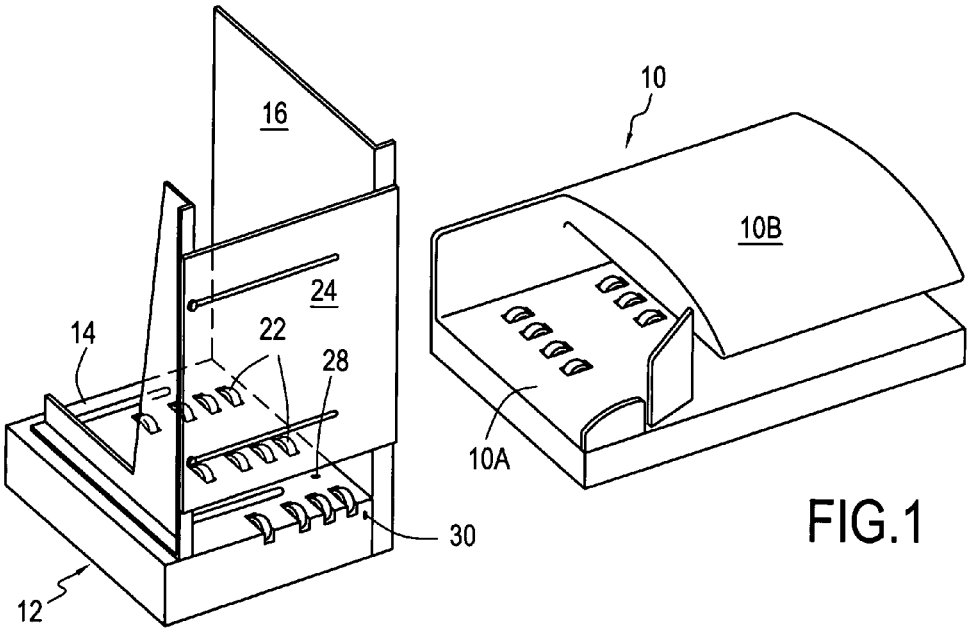
FIG.1
FIG.2
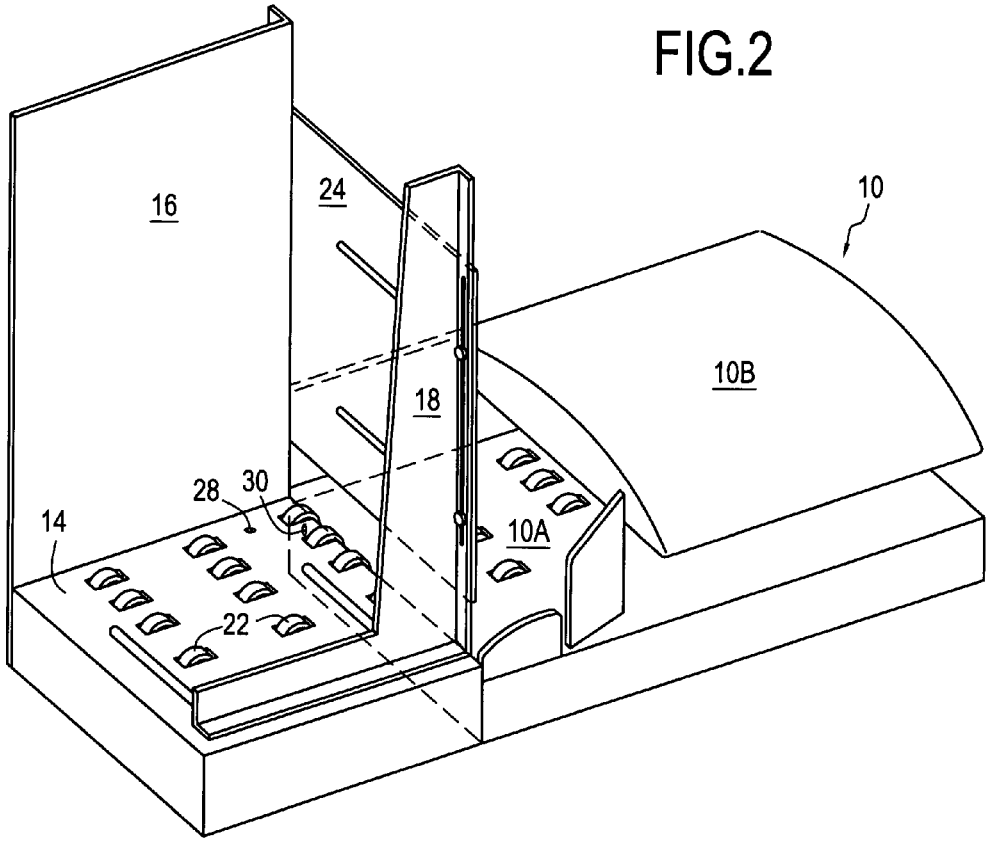

DEVICE FOR AUTOMATICALLY LOADING ENVELOPES

FIELD OF THE INVENTION

The present invention relates to the field of mail handling, and it relates more particularly to an envelope loader device for a mail handling machine.

PRIOR ART

A mail handling machine is conventionally made up of three main elements: a mail item feeder; a "postage meter" or franking station for franking the mail items, which station is disposed at the outlet of the feeder (which can optionally incorporate a weigh device); and, disposed at the outlet of the franking station, a device for receiving the mail items once they have been franked by the franking station.

Current machines can frank mixed mail, i.e. mail items of all weights and formats, such mail items being stored flat in the magazine of the feeder in a small-capacity stack (about 200 envelopes of medium thickness) so as to be franked on being individually extracted by the unstacking and selection means of the feeder. Such a small capacity, which is made necessary by said unstacking and selection means, limits the productivity actually achieved by the machine because it requires frequent action from the operator for loading the mail items into the feeder. By way of example, in order to obtain a franking throughput of 15,000 envelopes per hour, it would be necessary to refill the magazine of the feeder 75 times per hour, which, in practice, leaves the operator very little time for performing the other actions (unloading the envelopes, putting them into mail bins per format, etc.) also required in operating the mail handling machine.

There therefore currently exists an unsatisfied need for a solution for feeding a mail handling machine that makes it possible to achieve a loading capacity that is considerably larger than the capacity offered merely by the magazine of the feeder, and that, by freeing up time for action from the operator of the machine, guarantees an actually achievable franking throughput of 15,000 envelopes per hour and higher.

OBJECT AND DEFINITION OF THE INVENTION

An object of the present invention is to provide a loading device that is simple, compact, and ergonomic, while also having a feed capacity that is considerably higher than a standard feeder magazine, and that is not limited by the downstream functions of envelope unstacking and selection that are performed by the feeder.

These objects are achieved by an envelope loader device comprising a mail-receiving bed provided with conveyor rollers and serving to receive a stack of mail items, jogger means for holding the mail items against a referencing wall, and a drive motor for driving said conveyor rollers in rotation, said envelope loader device further comprising control means for actuating said drive motor and for causing a fraction of said stack of mail items to be ejected as a function of a mail presence sensor mounted at said mail-receiving bed and whose state depends on whether or not mail items are present in a downstream feeder device.

Thus, with this configuration, it is possible to unstack a small stack of envelopes from a much larger stack of envelopes and to feed the feeder automatically with said small stack.

Preferably, the device of the invention further comprises a mail presence sensor whose state depends on whether or not at least one mail item is present on said mail-receiving bed. Said mail presence sensors are chosen from among detectors of the mechanical type, detectors of the magnetic type, and detectors of the optical type.

Advantageously, it further comprises a guillotine door mounted at the outlet of said loader device and whose vertical positioning defines the thickness of the fraction of the stack of mail items that is ejected.

The present invention also provides a method implemented in this loader device, and in which, by acting on control means that act on said drive motor, it is possible to cause a fraction of said stack of mail items to be ejected as a function of whether or not mail items are present in a downstream feeder device, as indicated by a mail presence sensor mounted on said mail-receiving bed. Advantageously, the thickness of said ejected fraction of the stack of mail items is defined by the vertical positioning of a guillotine door mounted at the outlet of said loader device, and the presence of at least one mail item on said mail-receiving bed is detected by a mail presence sensor.

BRIEF DESCRIPTION OF THE DRAWINGS

The characteristics and advantages of the present invention appear more clearly from the following description given by way of non-limiting example, with reference to the accompanying drawings, in which:

FIGS. 1 and 2 are perspective views of a feeder for a mail handling machine, which feeder is associated with an envelope loader device of the invention.

DETAILED DESCRIPTION OF A PREFERRED EMBODIMENT

Figure 3:
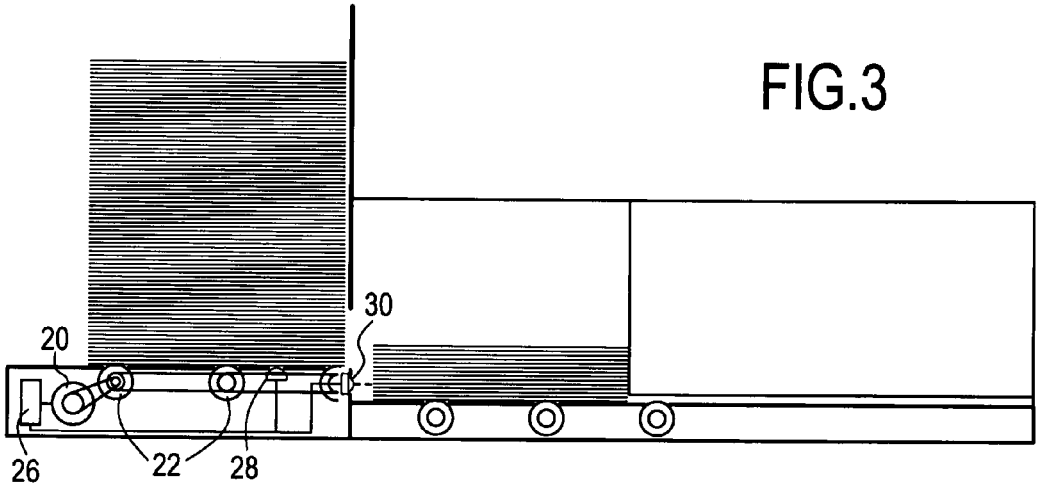
FIGS. 3 to 5 show various operating positions of the loader device of the invention.

FIGS. 1 and 2 are views showing a mail item loader device of the invention respectively in exploded perspective and in an operating position, the device being designed to be mounted upstream from a feeder of a mail handling machine.

This mail item feeder 10 conventionally comprises a bed 10A for receiving the mail items, and means 10B for unstacking the mail items and for selecting the unstacked mail items one after another. In order to enable the stack of mail items disposed on the mail-receiving bed to be managed correctly, i.e. in order to guarantee that unstacking takes place without jamming and without more than one mail item being selected at a time, the storage capacity of the feeder is limited to a height of about 200 millimeters (mm), which, in practice, corresponds to a storage capacity of about 200 envelopes of standard European format, each of which contains one sheet of paper of A4 format.

In the invention, this capacity is increased considerably by adding, upstream from the feeder, a loader device 12 having a mail-receiving bed 14 provided with a referencing wall 16 and with side jogger moving means 18 for receiving a first stack of mail items of considerable height and for holding said first stack in position. This loader device also has a motor-driven ejection system that is driven by a drive motor 20 (shown in FIGS. 3 to 5) acting on conveyor rollers 22, e.g. via toothed belts and cogs, and in association with a guillotine door 24, to extract a second stack of mail items from the first stack of mail items, said second stack having a height adapted to the handling capacity of the bed of the feeder towards which said second stack is ejected, this height being defined by the vertical positioning of the guillotine door. The drive motor is actuated by a processor module 26 (shown in FIGS. 3 to 5) depending on the state of two mail presence sensors, of the mechanical type, or of the magnetic type, or preferably of the optical type, disposed at the bed of the loader device, the first sensor 28 being disposed at the top wall of the bed in order to detect the presence of envelopes in said loader device, and the second sensor 30 advantageously being disposed on that side wall of the bed that faces the bed of the feeder, so as to detect the presence of envelopes on said bed of the feeder, e.g. by measuring the distance between said side wall and the sides of the envelopes.

Operation of the loader device of the invention is explained below with reference to FIGS. 3 to 5.

Figure 4:
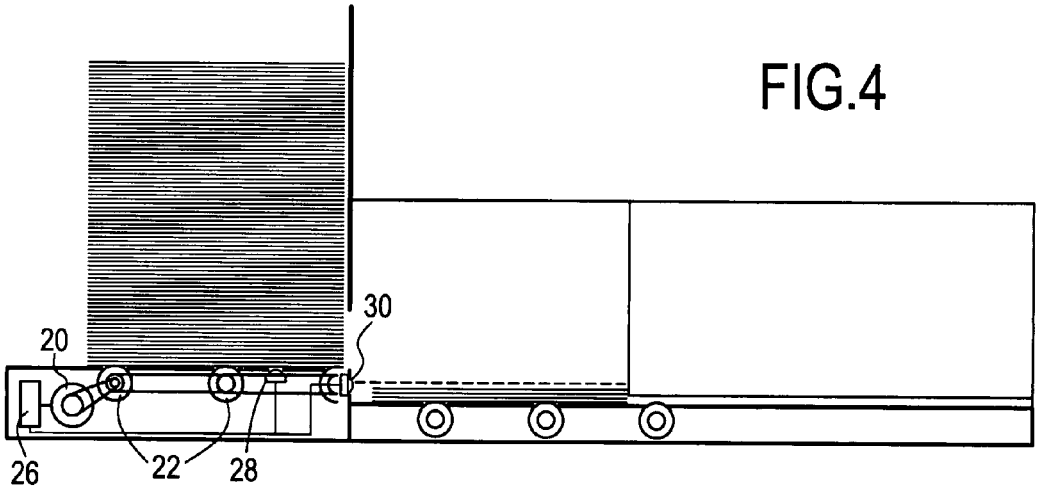

FIG. 3 shows the initial position of the loader device of the invention prior to switching on the mail handling machine (not shown). In this position, the beds of the loader device and of the feeder of said mail handling machine have both been loaded by the operator with their respective stacks of envelopes. Typically, about 200 envelopes are disposed on the bed 10A of the feeder and advantageously approximately in the range 600 envelopes to 800 envelopes are disposed on the bed 14 of the loader device. In this initial position, the drive motor 20 of the loader device is at rest, and the envelopes contained in said loader device are therefore stationary. The mail presence sensors 28, 30 in the loader device and in the feeder are in "high" initial positions indicating that mail items are present both in the loader device and on the mail-receiving bed of the feeder.

Switching on the mail handling machine causes the feeder to operate. The feeder then proceeds to unstack its stack of envelopes and to eject the envelopes one-by-one towards the franking station of said machine, so that, 50 seconds later (for a throughput of 15,000 envelopes per hour) the configuration shown in FIG. 4 is reached, in which only about ten envelopes remain (i.e. enough to feed the machine for less than 3 seconds) on the mail-receiving bed of the feeder and in which the second mail presence sensor 30 goes to a "low" level, thereby indicating that the feeder will soon be empty and that it needs to be re-stocked (subject to the first mail presence sensor 28 being at its "high" level, indicating that envelopes are present in the loader device).

Figure 5:
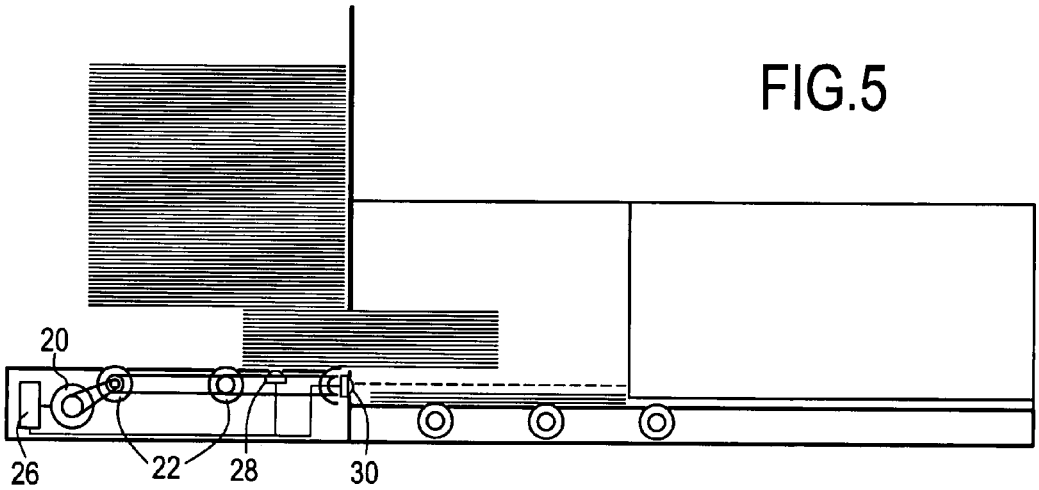

This re-stocking step is shown in FIG. 5. It corresponds to the drive motor 20 being switched on, thereby causing the carrier rollers to move simultaneously so as to unstack a fraction of the stack of mail items from the loader device (in practice, the set of mail items that are not stopped by the guillotine door 24). During this movement, the feeder continues to eject the last few mail items remaining on its bed one-by-one and at a rate of one every 240 microseconds (ms) when the throughput is 15,000 envelopes per hour, so that, when the stack from the loader device is unloaded onto the bed of the feeder, the feeder has hardly more than one or two envelopes remaining to be handled.

Once the stack of envelopes has been received by the feeder, the feeder bed finds itself in a position similar to the position of FIG. 3 (ignoring the number of envelopes remaining on the bed), the second mail presence sensor going back to a "high" level due to the presence of the new mail items, and the drive motor is switched off.

Thus, with the invention, the envelope feed capacity is increased. The ease of loading is particularly advantageous for the operator since the original capacity of the feeder bed is very small. In addition, the drive mechanism for moving the envelopes is simplified to the maximum extent, making it possible to implement a loader device that is compact.

It should be noted that, in order to simplify the drawings and facilitate understanding, the difference in level between the bed of the feeder and the loader device is accentuated relative to the real difference. It should also be noted that, although the above description is made essentially with reference to a feeder for a mail handling machine, the loader device of the invention is naturally also applicable to any other type of feeder.

What is claimed is:

1. A loader device adapted to be positioned upstream of a feed device of a mail handling machine for supplying mail items to the feed device, said loader device comprising:

a mail-receiving bed provided with conveyor rollers and serving to receive a stack of said mail items;

jogger means for holding the mail items against a referencing wall;

a drive motor for driving said conveyor rollers in rotation;

a mail presence sensor mounted at said mail-receiving bed of the loader device for detecting the presence of mail items at the feed device; and control means for actuating said drive motor and for causing a fraction of said stack of mail items to be ejected as a function of a detection state of the sensor.

2. A device according to claim 1, further comprising a mail presence sensor whose state depends on whether or not at least one mail item is present on said mail-receiving bed.

3. A device according to claim 1, wherein said mail presence sensors are chosen from among detectors of the mechanical type, detectors of the magnetic type, and detectors of the optical type.

4. A device according to claim 1, further comprising a guillotine door mounted at the outlet of said loader device and whose vertical positioning defines the thickness of the fraction of the stack of mail items that is ejected.

5. A method of loading mail items on a feeder of a mail handling machine from a loader device disposed upstream of said mail handling machine, said loader device comprising a mail-receiving bed provided with conveyor rollers for receiving a stack of mail items, jogger means for holding the mail items against a referencing wall, a drive motor for driving said conveyor rollers in rotation, a mail presence sensor mounted at said mail-receiving bed for detecting the presence of mail items at the feed device and control means for actuating said drive motor and for causing a fraction of said stack of mail items to be ejected as a function of a detection state of the sensor, said method comprising the following steps:

loading a stack of mail items on the feeder;

loading another stack of mail items on the mail-receiving bed of the loader device;

detecting with the mail presence sensor when a number of mail items on the feeder device is below a predetermined number;

in response to said detection, feeding additional mail items from the mail-receiving bed to the feeder.

6. A method according to claim 5, further comprising the step of controlling a number of mail items fed from the mail-receiving bed to the feeder by the vertical positioning of a guillotine door mounted at the outlet of said loader device.

7. A method according to claim 6, further comprising the step of detecting the presence of at least one mail item on said mail-receiving bed by a mail presence sensor located on the mail-receiving bed.

* * * * *